United States Patent [19]

Babson et al.

[11] 4,100,864

[45] Jul. 18, 1978

[54] AUTOMATIC WORK GUIDANCE MECHANISM

[75] Inventors: Edward Spencer Babson, Ipswich; Donald Franklin Herdeg, South Hamilton; William Burrows Mercaldi, Beverly, all of Mass.

[73] Assignee: USM Corporation, Farmington, Conn.

[21] Appl. No.: 760,138

[22] Filed: Jan. 17, 1977

[51] Int. Cl.[2] ..... D05B 19/00; D05B 27/14

[52] U.S. Cl. ..... 112/121.11; 112/153; 112/204

[58] Field of Search ..... 112/121.12, 121.11, 112/153, 204, 205, 212

[56] References Cited

U.S. PATENT DOCUMENTS

| | | | |
|---|---|---|---|
| 3,080,836 | 3/1963 | Clemens et al. | 112/203 X |
| 3,139,051 | 6/1964 | Story | 112/204 |
| 3,650,229 | 3/1972 | Rovin | 112/153 X |
| 4,019,447 | 4/1977 | Blessing et al. | 112/121.11 |

*Primary Examiner*—H. Hampton Hunter

*Attorney, Agent, or Firm*—Carl E. Johnson; Richard B. Megley; Vincent A. White

[57] ABSTRACT

Work feeding and automatic guidance mechanism are combined in a single curvature-controlled means located on one side of a workpiece being progressively processed in a machine, for instance a stitcher. Accordingly, separate feed dog mechanism or equivalent is eliminated. The feeding-steering means preferably comprises a rotary ring orbitally driven about an operating tool such as a needle, and effects guidance and feeding of the work synchronously in intervals when the tool is disengaged from the work.

16 Claims, 9 Drawing Figures

AUTOMATIC WORK GUIDANCE MECHANISM

BACKGROUND OF THE INVENTION

This invention relates to the provision of improved automatic pattern-controlled mechanism for feeding and at the same time guiding a workpiece relative to an operating tool.

More especially the invention is concerned with providing simplified mechanism for automatically controlling incremental feeding and guidance of a flexible sheet-like workpiece in the successive intervals when an operating tool, for instance a sewing needle, is inoperative whereby a desired operating path is established according to some predetermined pattern or curvature-controlling means such as a workpiece edge.

It is well known in the machine tool industry to predetermine, by means of numerical or other data control, an operating path of a tool with respect to a rigid workpiece. In the case of operations upon lighter-weight work and flexible sheet materials, where it is usually preferable to move the work relative to a tool, rather than vice-versa, in establishing an operating path, several automatic work guidance approaches are also known and include, for example, those disclosed in U.S. Letters Pat. No. 2,979,745 to Schaefer et al; 3,034,781 to Touchman et al; and 3,080,836 to Clemens et al.

Automatic guidance of a flexible, even flimsy workpiece is often important to industry in expeditiously producing neat, uniform, and lower cost products. Difficulty arises in overcoming inertia of the workpiece so that precise increments of linear feed in a single direction and/or as required by changes in direction can be efficiently accomplished and without interfering with an operation or process as the work is appropriately moved. It has been proposed in the prior art to provide a rectilinear feeding of the work by one intermittently or continuously operative feed means in combination with a separate steering means which would exert guidance torque when the feed means was inoperative or ineffectual. It is also old to provide, as disclosed in U.S. Letters Pat. No. 3,650,229 to Rovin, in combination with a feed dog mechanism of the orbital type, a rotary friction means operable on the opposite side of the workpiece from the feed dog for varying the course of sheet material. Yet another automatic guidance mechanism for a sewing machine is disclosed in U.S. Letters Pat. No. 3,693,561 to Hrinko et al wherein a feed dog operates on one side of a workpiece to advance it relative to a needle, and on the opposite side of reversibly rotative guide ring surrounding the needle is responsive to edge sensing means for orienting the work during non-feeding and as it is being sewn.

Commerical acceptability of the prior art approaches to automatic work guidance means for sewing machines and other types operable on sheet material has, for various reasons, not hitherto proven generally practicable.

SUMMARY OF THE INVENTION

In view of the foregoing it is a primary object of this invention to provide an improved automatic curvature-controlled work guidance mechanism which shall be more accurate, reliable, and productive, and be of a versatile structure capable of embodiment in various types of existing machines dealing with flexible workpieces.

More specifically, it is an object of this invention to provide, for use in a high speed stitcher, for example one for attaching edge binding such as French cord progressively to the margin of sheet material such as a shoe upper, an edge curvature or pattern-controlled guidance means for automatically determining the path of the seam.

To these ends, and as herein shown, the present invention permits elimination of an under-dog feed means and the provision of a top or compound feeding-steering means which is responsive to a servo system automatically controlled, for instance, by edge curvature sensing or pattern guidance means. The compound feeding-steering means herein illustrated uniquely enables steering during feeding and preferably is an orbital rotary, work-engageable ring member adapted to respond to the servo system including, for instance, a light detecting solar cell which will not signal for rotation of the ring member unless departure from rectilinear feed is determined to be in order. This is advantageous over the arrangement in the mentioned Clemens et al patent 3,080,836, for example, in that any drag effect on the work is avoided, and unneeded but attempted steering correction or "hunting tendency" is avoided. Edge sensing is operative when the ring member is rotated to orient or steer the work and to advance it toward the operating locality of a tool such as a reciprocable needle.

In accordance with a further feature of the invention cam switches render the servo system inoperative just before an anti-flag or hold down contacts the work and until the anti-flag is separated from the work, thereby protecting the needle which has penetrated the work in this interval of a cycle. Upon detection of deviation in work curvature in a portion within or just ahead of the ring, an appropriate correcting signal is fed to a servo motor which acts, through drive mechanism, to rotate the ring and apply appropriate frictional steering torque to the work substantially simultaneously with a force to advance the work; the resultant advantage is to attain more accurate edge or pattern following since correction of a sensed guidance error need not be delayed for a full increment such as the length of a stitch.

Additional novelty resides in the provision of a non-complex driving mechanism coupling the fixedly mounted servo motor to the mentioned compound feeding-steering means and enabling the latter to be rotatively driven during translation through a speed reducer and a drive belt, allowing steering corrections while maintaining the work in flat and undisturbed condition. A further feature relates to provision of a means for automatically disabling inside and outside "corner" detecting means during the inoperative portion of each cycle of the ring thereby avoiding a possibly erroneous signal therefrom.

BRIEF DESCRIPTION OF THE DRAWINGS

The foregoing and other features of the invention will now be more particularly described in connection with an illustrative embodiment and with reference to the accompanying drawings thereof, in which.

DESCRIPTION OF THE PREFERRED EMBODIMENT

Although the invention will be explained as applied, by way of example, to a French cord stitcher, it will be understood that the invention is not limited in use to any particular type of sewing machine nor, indeed, to any specific form of machine or operation other than that it is to progressively process a flexible workpiece, usually of sheet material, over an operating path which may be non-rectilinear at least in part and is automatically predetermined by pattern means, for instance parallel to an edge.

Figure 1:
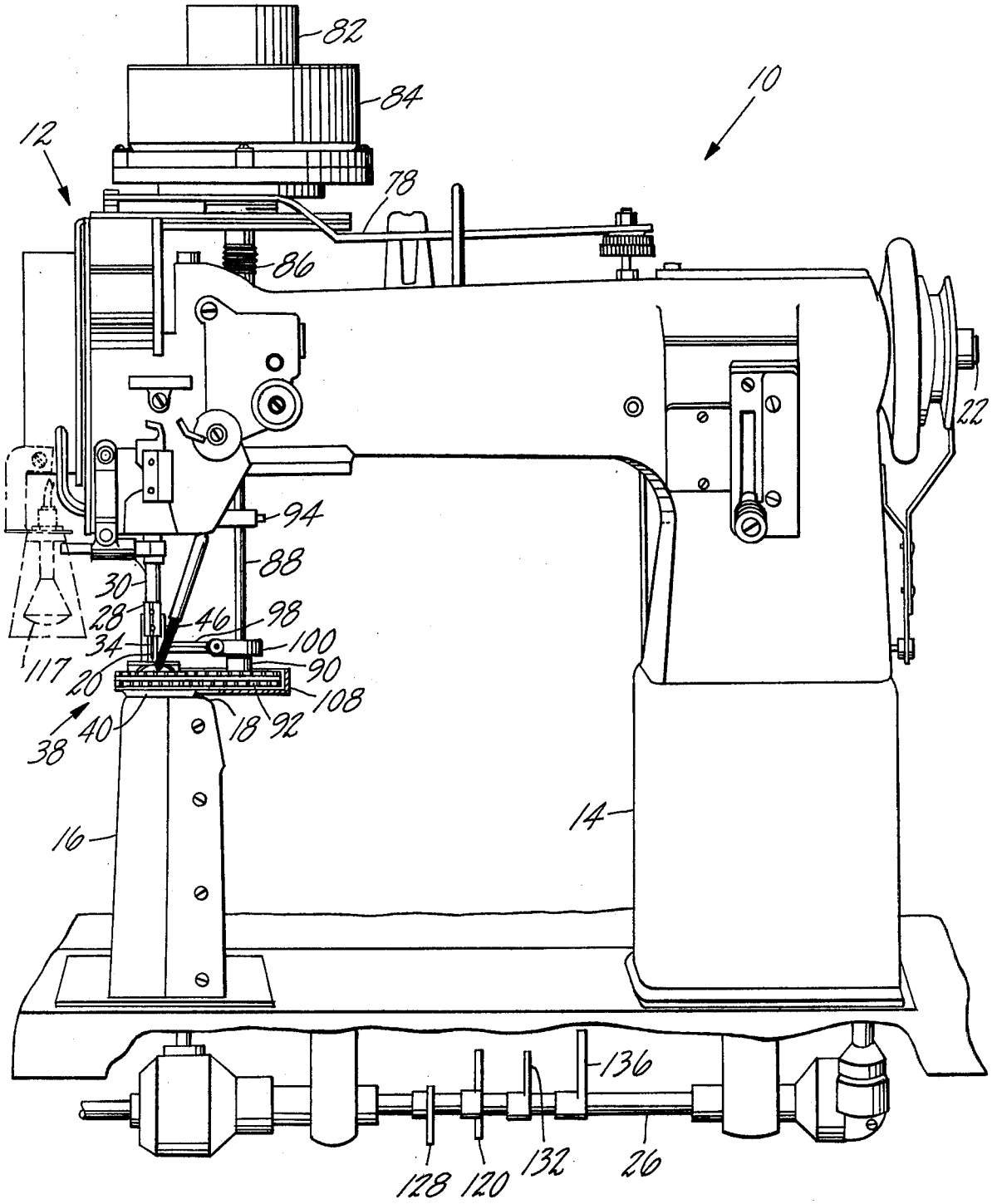
FIG. 1 is a view in front elevation of a French cord sewing machine embodying automatic work guidance mechanism, all parts being at rest at the start of a cycle, and portions of a base being removed to disclose a bobbin drive shaft with certain control means.
Figure 2:
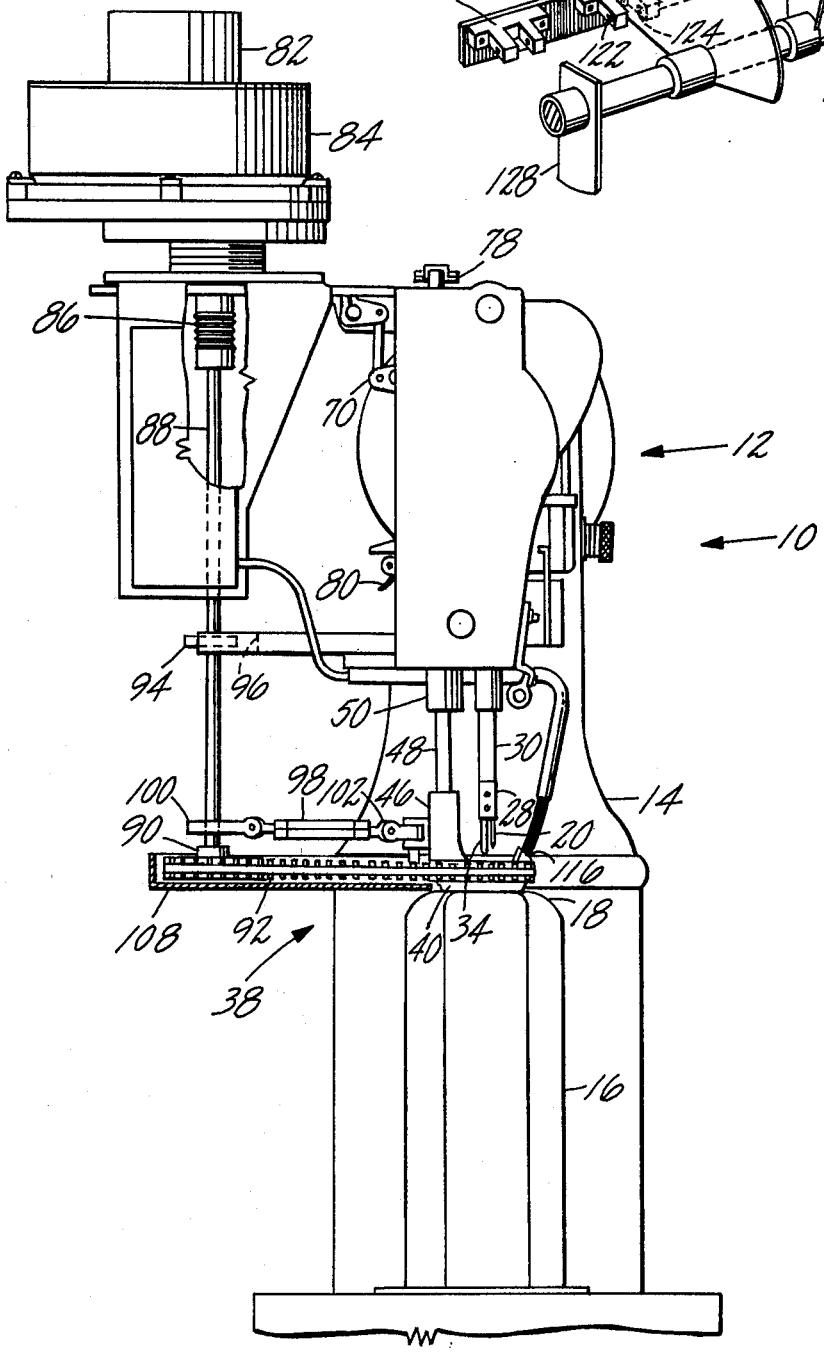
FIG. 2 is a view in end elevation, with a portion broken away, of the machine of FIG. 1, its needle and anti-flag being shown raised from a work supporting post, and an orbitally driven feeding-steering ring being in lowered work engageable position in relation to the post.

As herein shown the invention is embodied in a high-speed, single needle, largely conventional lockstitch type sewing machine generally designated 10 (FIGS. 1, 2, 4) which is currently commercially available except for significant novel modifications to be mentioned including automatic guidance means about to be more particularly described. The machine comprises a head 12 (FIGS. 1–3), on a hollow C-frame 14, a post 16 providing a work supporting surface 18 spaced beneath the head, and stitch forming means carried by the head and including a vertically reciprocable needle 20. The machine also comprises a rotary main shaft 22 (FIGS. 1, 5), an oscillatory shaft 24 (FIG. 5) (preferably having adjustable amplitude) for purposes later explained, and a rotary shaft such as a bobbin drive shaft 26 (FIGS. 1, 3).

In usual manner the needle 20 depends from and is connected by a coupling 28 to a vertically reciprocable needle post 30 (FIGS. 2, 5) extending from the head and having bearings in a fixed machine frame portion 32 (FIG. 5) and operative connection to the main horizontal drive shaft 22. Sewing thread ST (FIG. 4) is supplied in usual manner and, for purposes of this illustration, French cord FC (FIG. 6) is also progressively advanced to the operating locality of the needle from a supply in conventional manner to be secured by the thread along a workpiece edge as a binder. A hold down or anti-flag 34 is vertically reciprocable in a bore formed in the coupling 28, being spring-urged downwardly by a spring (not shown) and a stroke-limiting pin transversely received by the coupling and a vertical slot in the side of the pin. The anti-flag arrangement is such (see FIG. 9) that it engages the work just ahead of the needle 20 in each cycle and leaves just after it.

Figure 3:
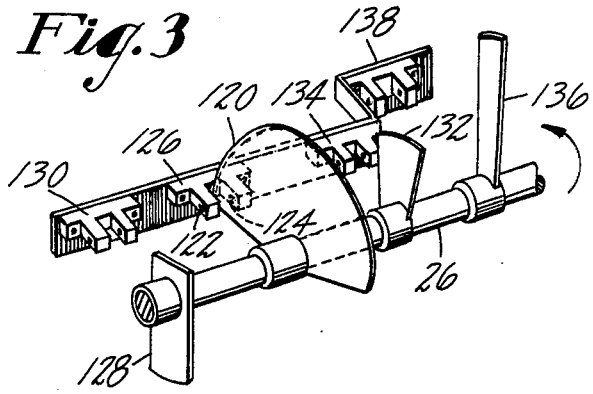
FIG. 3 is a perspective view of the bobbin shaft at start of servo action and controls shown in FIG. 1.
Figure 4:
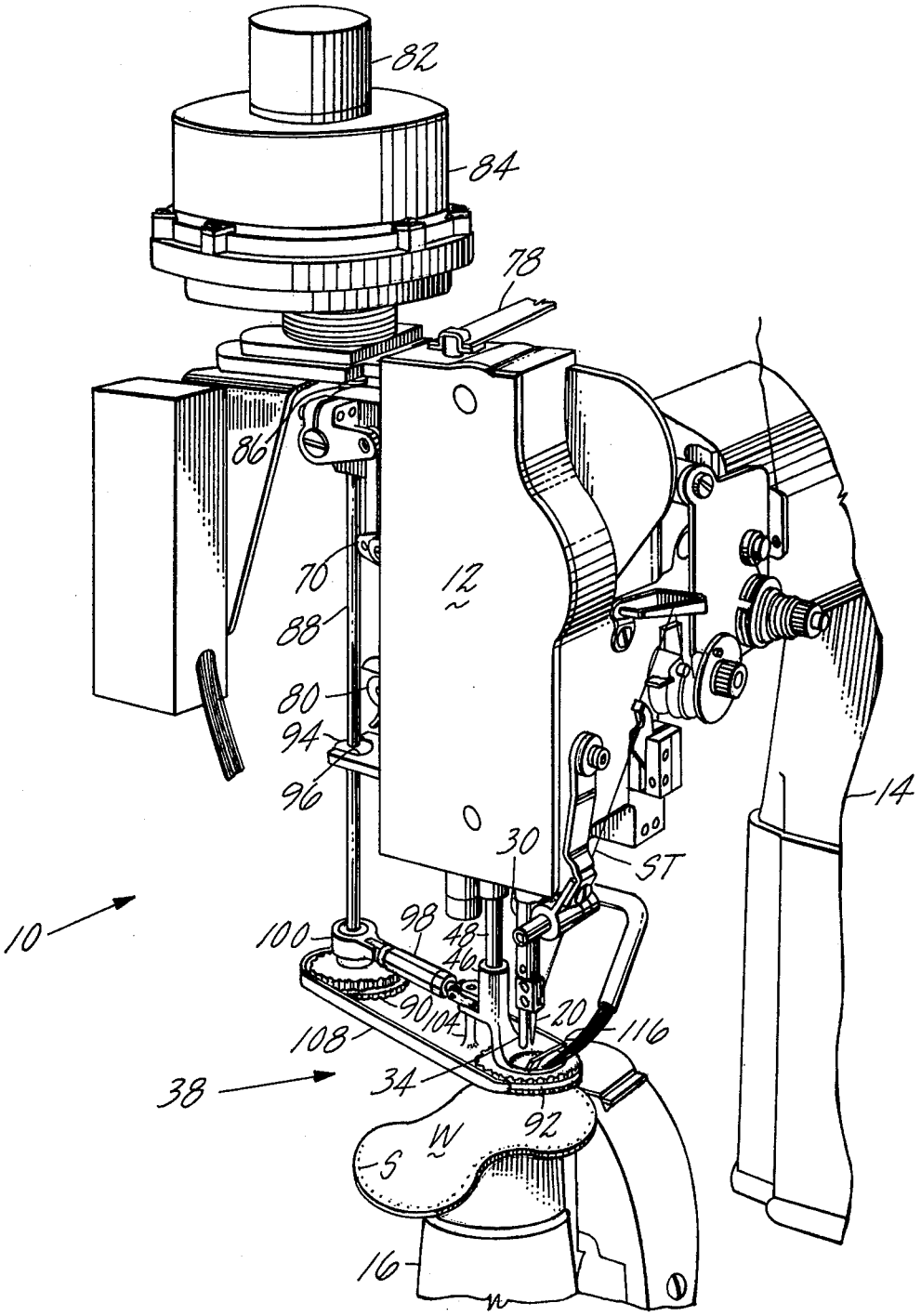
FIG. 4 is a perspective view of the upper portion of the machine shown in FIGS. 1 and 2, a typical workpiece being shown in position for edge guidance and attachment of French cord.
Figure 5:
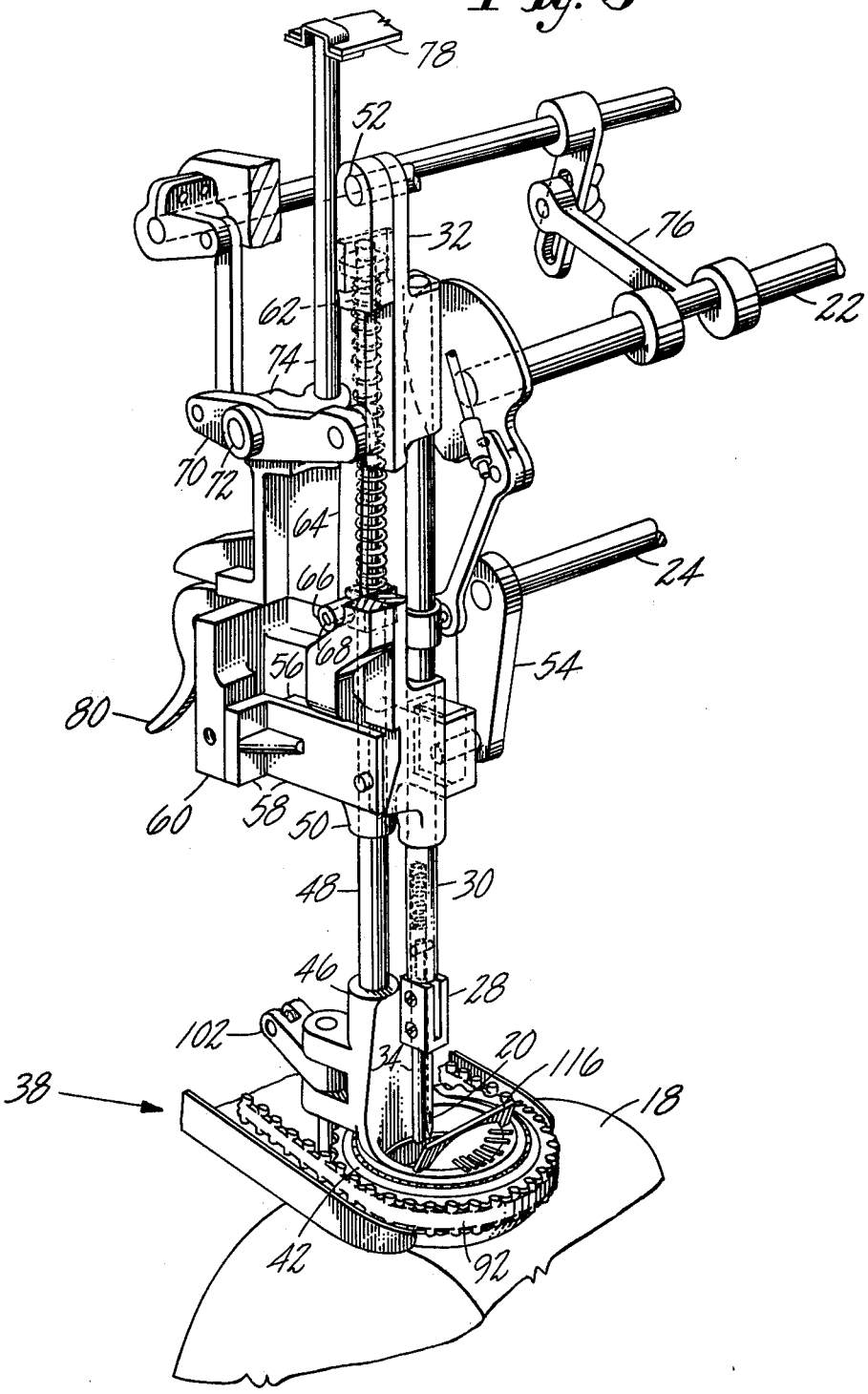
FIG. 5 is a perspective view of mechanism for driving the needle and moving the ring heightwise.
Figure 9:
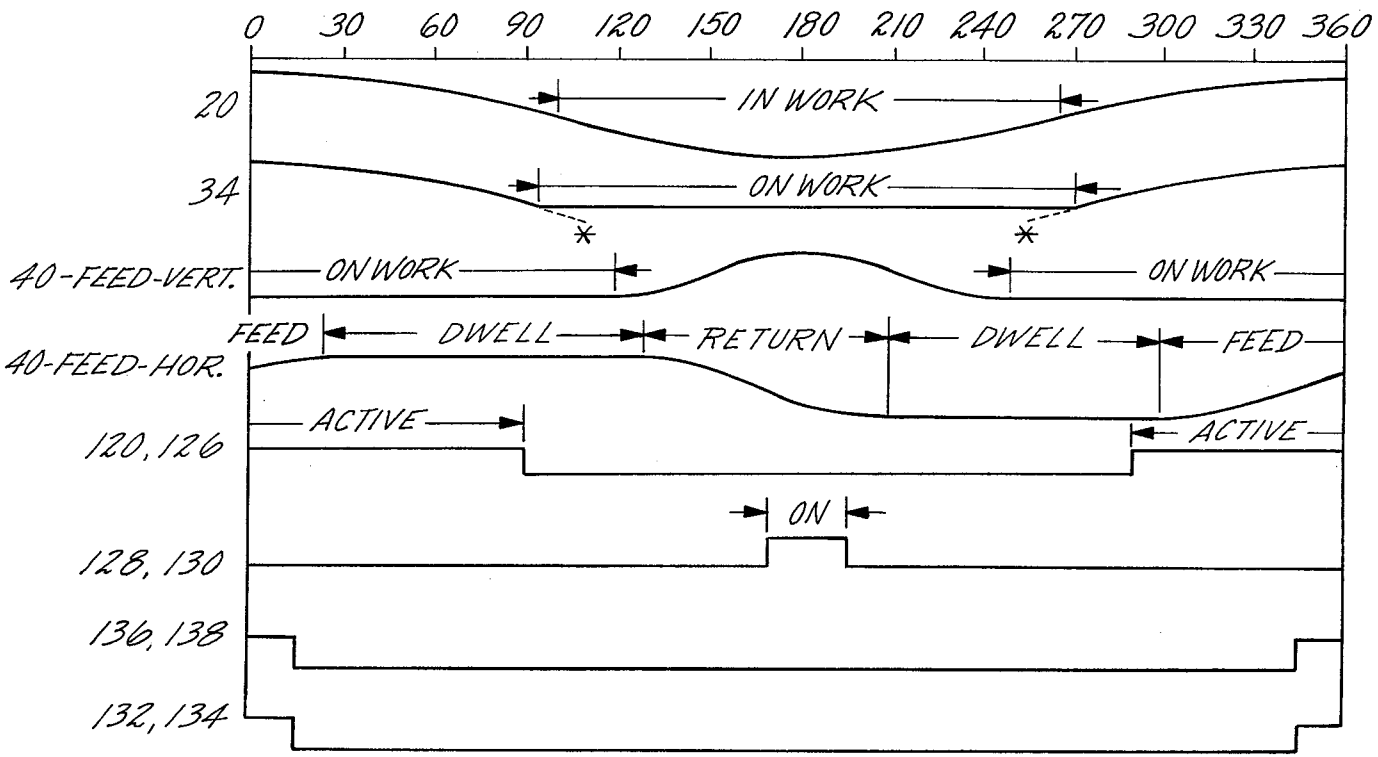
FIG. 9 is a timing chart for a typical cycle of the machine.

Material to be progressively processed by the machine, such as representative workpieces W shown in FIGS. 3-5, slide over the top of work supporting surface 18 of the post 16 which may be coated with a low sliding friction substance such as polytetrafluoroethylene, having a trade name "Teflon". This coating facilitates effective automatic operation of a compound feeding-steering means generally designated 38 to be described and engageable only with the upper side of the work. No under-feed mechanism (such as an orbital dog) is provided or needed. The means 38 preferably comprises an orbitally driven, rotary ring 40 preferably having a work engaging under-surface 41 of urethane and operative frictionally parallel to the surface 18 and about the work penetrating locality of the needle 20. For better accommodation of different thicknesses of work, the ring 40 may be spring-loaded as will be described and, more accurately, its trajectory is D-shaped, i.e. it has a lower flat side corresponding to a horizontal work-feeding and steering increment, the remainder of the closed operating path including a vertical component of movement. The work-feeding and the work-steering movements are largely synchronous as indicated in FIG. 9 and respectively controlled automatically by mechanisms next to be described with reference chiefly to FIGS. 5-8.

For imparting translatory incremental feed to the work W by means of the ring 40 during its frictional engagement therewith, the ring is secured to a sprocket wheel 42 (FIGS. 1, 5-8) rotatably carried by a ball bearing 44 (FIG. 8) mounted in the lower end of an annular holder 46. The latter is formed to be secured to the foot of a vertically disposed rod 48 (FIG. 5) reciprocably controlled both heightwise and in translation. Thus, the rod 48 is vertically reciprocable in a sleeve bearing formed in the lower end of a lever 50 pivoted about a fulcrum pin 52 in the frame portion 32, the lever 50 being oscillated by means of an arm 54 on an end of the shaft 24. A guide block portion 56 of the lever 50 slides in a guideway provided by a bracket 58 secured to another fixed frame portion 60 subsequently to be referred to again. To enable the ring 40 to accommodate different thicknesses of work, the upper portion of the rod 48 receives, between a lug formed on the lever 50 and a block thereon, a take-up or compression spring 62.

The vertical motion of the ring 40 at the opposite extremities of its feed and return strokes is here shown as derived from the main shaft 22. For this purpose a link 64, still referring mainly to FIG. 5, has a boss 66 at one end for receiving a pin 68 laterally extending from the lever 50, the upper end of the link being pivotally suspended from one end of a lever 70. This lever 70 is, for a reason about to be explained, pivotally mounted on a vertically movable fulcrum pin 72 which is carried by a member 74. An opposite end of the lever 70 is operatively connected through adjustable linkage and a stub shaft 76 to an eccentric formed on the main shaft 22. In well known manner a downwardly biased end of a leaf spring 78 (FIGS. 1, 4, 5) urges the member 74 downwardly into abutting relation with the frame portion 60 to bring the ring 40 down into operative relation to the work supporting surface 18, but a cam 80 pivotally mounted on the portion 60 is manually movable (clockwise as seen in FIG. 5) to abut an under-surface of the member 74 and thus cause the ring to be elevated, when desired, to an inoperative position permitting easy admission or removal of a workpiece from the operating zone. It will be understood that FIG. 5 illustrates one means for imparting orbital or "D" feed motion to the ring 40 as described, and that other generally equivalent feed mechanism, may be substituted in whole or in part without departing from this invention.

Figure 6:
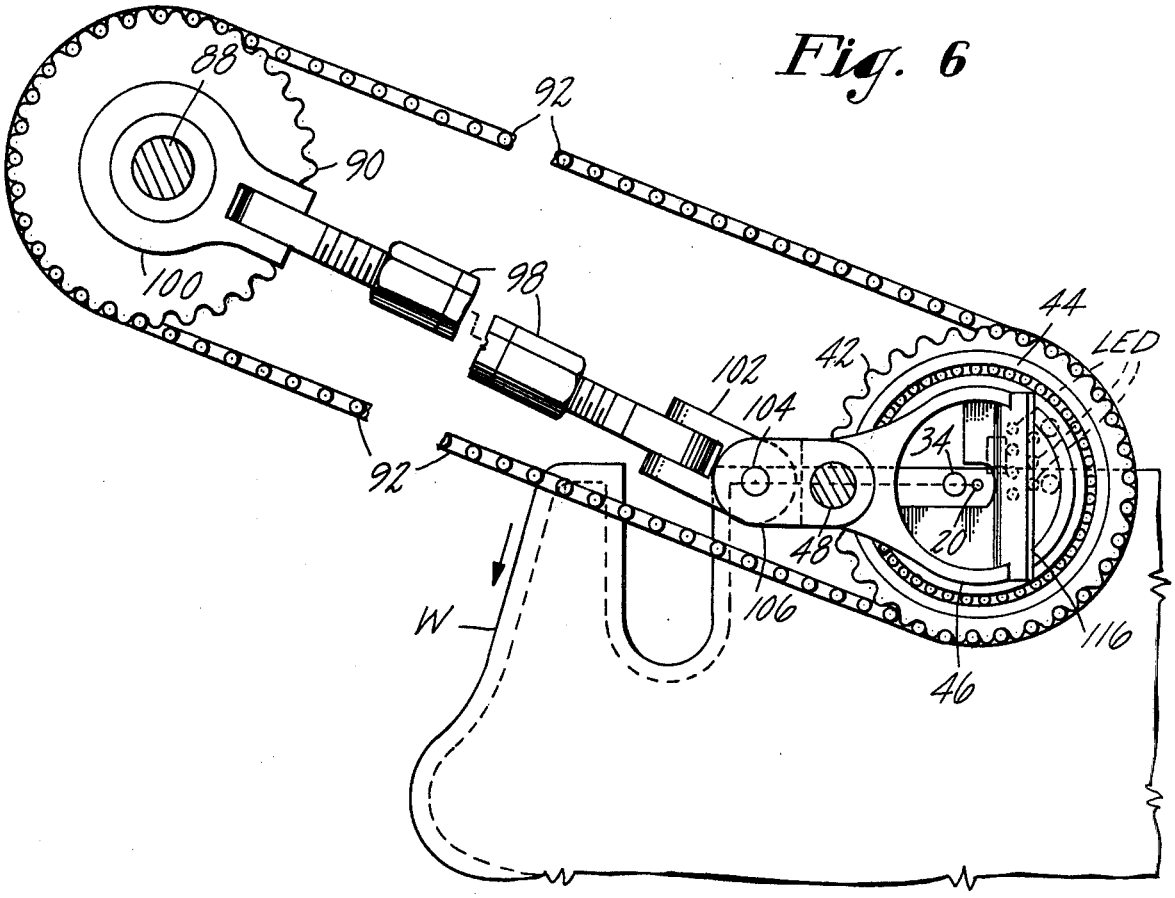
FIG. 6 is an enlarged plan view showing a portion of the mechanism for rotatably driving the feeding-steering ring and its operative relation to a workpiece controlled thereby.

In order to enable the ring 40 also to automatically steer the work according to predetermined curvature or pattern means, for instance an edge contour, and thereby establish the operating path of a tool (such as the needle 20 in this illustration) on the work, mechanism is provided as next described for causing the ring to rotate appropriately in each cycle about a substantially vertical axis which is, or is nearly, coincidental with that of the needle. Ring rotation is caused only concurrently with the translational feeding increment. As indicated in FIG. 9, the needle is not penetrating the work while the feeding and the steering torque are being effectively and simultaneously frictionally imparted by the ring; this is to say that the ring 40 descends onto the work at the start of a feed increment, and then the needle 20 lifts out of the work just before the anti-flag rises therefrom. Accordingly, it will be incidentally noted, the arrangement has definite advantage over that of the mentioned Clemens et al U.S. Pat. No. 3,080,836, for example, in that there the offset steering wheel exerted a drag on the work during its feed interval imposing a solar cell signal error which the system was continuously attempting, by "zig-zags", to correct. Here the steering mechanism controlling rotation of the ring 40 comprises a servo motor 82 (FIGS. 1, 2, 4) rotatably driving, through reduction gearing 84 and a bellowstype universal coupling 86, a vertical drive shaft 88, the lower end of which carries a sprocket 90 for meshing with an endless belt 92 that rotates the sprocket 42. Preferably a bearing 94 on the shaft 88 extends for guidance in an open-slot 96 provided by a bracket secured to the machine frame. As best shown in FIG. 6, for enabling the servo system precisely to control belt drive to the ring 40 and not be adversely affected at any time by translatory or heightwise motion thereof relative to the fixed driving axis of the motor 82, a composite take-up or turnbuckletype link 98 has one end pivotally connected to a bearing 100 in which the shaft 88 is journalled. The other end of the link 98 is pivotally connected to the ring-holder 46 by means of a clevis 102 (FIGS. 2, 6, 8) one end of which receives a vertical pivot pin 104 that is also pivotally received in aligned bores of lugs 106, 106 formed on the holder 46. The lower end of the pin also serves to support a shield 108 for preventing unintended interference of the work W with compound motion of the ring 40 and its driving means. If desired, the shield 108 may extend further to the right than shown in FIG. 8, a circular opening then being provided in its bottom for the ring 40 to extend therethrough.

Figure 7:
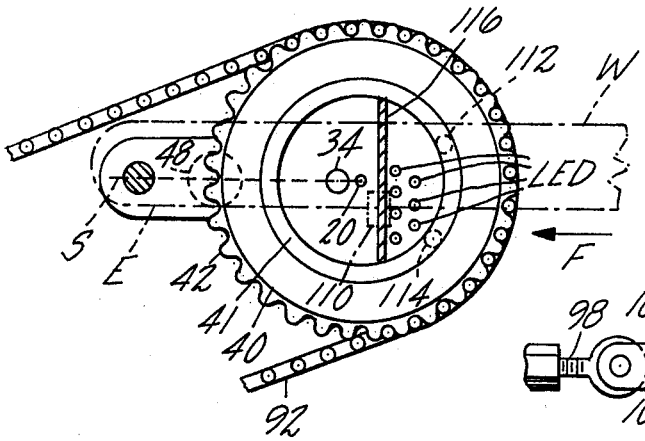
FIG. 7 is a bottom view of the feeding-steering ring indicating its operative relation to associated instrumentalities and while controlling movement of a relatively narrow or strap-type workpiece.
Figure 8:
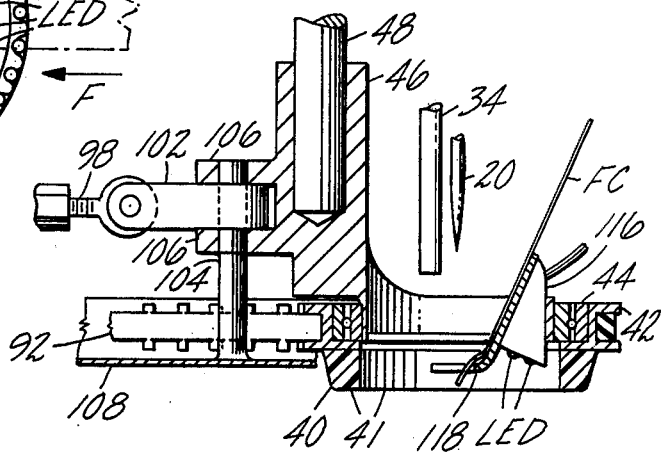
FIG. 8 is a vertical section showing the mounting of the ring and French cord delivery to the needle operating zone.

Curvature or pattern responsive control means for the guidance servo system will next be described. As indicated in FIG. 7 the work supporting surface 18 has three solar cells mounted thereon. A first cell 110 is for detecting change, if any, in curvature of a control pattern such as a workpiece edge E and is arranged slightly ahead (upstream) of the operating locality of the needle 20, considering the direction of work feed indicated by the arrow F, and to one side of that locality since of course the needle must penetrate the work. A second solar cell 112 further ahead of the needle detects outside "corners", i.e. significant change in convex or outside edge curvature, and the third cell 114, at the opposite side of the edge E being sensed and ahead of the needle path similarly senses inside or concave edge curvature. All three cells may, in the absence of a workpiece, be fully illuminated by light from a bank of light emitting diodes designated LED (FIGS. 6-8) affixed by a bracket 116 to the inside of the holder 46 and ahead of the needle operating locality. The LED are herein assumed to be "on" continuously during operation of the machine, but it will be understood they may, by the use of a vane switch, be turned off during the non-feeding portion of a cycle. The cells 112 and 114 are preferably positioned within an area not much larger than that defined by the path outlet of the circumference of the work engageable surface 41 of the ring. An optional light source 117, (FIG. 1) mounted on the machine is provided when the cells 112 and 114 are outside of the area illuminated by the ring-mounted lightemitting diodes LED. In this instance it may also be noted a guide 118 for the leading end of the French cord being attached is also secured to the bracket 116.

If the workpiece W being guided has changing edge curvature within or just ahead of the feeding-steering ring 40, an electrical signal from the cell 110 either increases or decreases as the work edge is progressively fed by the ring depending on whether the curvature is convex or concave, but if the edge E approaching the needle operating locality is straight, as shown in FIG. 7, the light falling upon the cell 110 from the LED bank remains constant as the work is advanced and the servo system remains in null balance, no signal being sent for operation of the motor 82. Hence, no rotation is then imparted to the ring 40 during work feed. Deparature from the servo system null by more or less of the cell 110 being exposed, by reason of work edge curvature, to the LED illumination results in a correcting signal being sent to the motor 82 whereby the ring 40, in the course of feeding, will turn about a substantially vertical axis and frictionally cause the work to rotate in appropriate direction. An important feature of the ring feeding-steering being described over any other known prior attempts to move work by a ring member resides in the fact that, advantageously, correction of a sensed edge guidance error or deviation is made substantially at once and without awaiting until after the current feed increment or stitch has been made. Capability of following a pattern or edge more accurately is thus enhanced. It is appreciated that, since correction in any system requires an error to be sensed during feeding and this requires time, rotation of the ring 40 to effect work orientation or guidance necessarily commences and is completed in each cycle slightly after a feed increment starts and stops.

The bobbin drive shaft 26, being synchronized with the main drive shaft 22, is or may be employed for control purposes as next explained with reference primarily to FIGS. 1, 3 and 9. A sectorial vane 120 is affixed on the shaft 26 and arranged to interrupt a light beam otherwise continuously directed from a photocell 122 to a receiver 124 in a unit 126 secured beneath the post surface 18. With the beam intercepted by the vane 120 the servo motor 82 is activated for the time when the ring is in work engagement (see FIG. 9).

A reading of the imminent inside corner curvature or outside corner curvature of the work guidance pattern is also taken cyclically by the cells 114, or 112, respectively, during beam interception by a vane 128 on the shaft 26 and arranged to pass between the photocell and receiver of a unit 130 like the unit 126. Preferably, the angular width and position of the vane 128 are such as to enable this reading to be taken at the instant when the ring 40 and hence the LED bank are raised but about to descend toward the work. Activation of either of the corner sensors 112, 114, when sufficiently covered by a work edge, signals mechanism (not shown) which slows operation of the machine until the approaching corner passes the point of needle operation, and additionally the arrangement preferably is such that, for an inside corner, means (not shown) is automatically actuated by pulse for shortening stitch length until the radius of edge curvature again enlarges to a predetermined degree. It may suffice in the course of the D-shaped locus of the ring 40 to render illumination from the LED bank inoperative for a portion of each cycle and yet insure that active accurate guidance is provided during the feed motion, i.e. while the ring 40 is lowered onto the work, and also the corner cells 114 and 112 are properly illuminated. Accordingly, in some applications, it may be advantageous to provide more intense illumination specifically during the period of sensing, preferably starting at that moment when the ring is about to descend onto the work, and ending after it has lifted therefrom, than to provide less illumination over a longer period or the whole of each cycle. It will be understood that when preferred the vane 120 may be omitted and the LED illumination maintained continuously during machine operation.

In order to have the sewing machine stop with its needle in the up position, which is necessary for the cutting of threads and the removal of the work, the shaft 26 rotatably carries an arm 132 (FIGS. 1, 3) an end of which is arranged to intercept a beam each cycle at the time when the needle is up. Thus vane 132 cyclically interrupts light passing between a photocell and receiver of unit 134 (similar to those designated 126, and 130).

For pre-programming purposes, for instance, determining curvature of the operating path of a tool by numerical control, or initiating automatic work ejection or cessation at a predetermined locality, the shaft 26 may also rotatably carry a vane 136 (FIGS. 1, 3) an end of which is arranged to intercept a beam each cycle for counting successive stitches or feeding increments. As illustrated, each count is desirably made while the needle is up, i.e., has completed a stitch. Thus, the vane 136 may cyclically interrupt light passing between a photocell and receiver of a unit 138 (FIG. 3, similar to those designated 126, 130 and 134) and upon completion of a certain number of stitches (or feed increments) an appropriate circuit (not shown) is triggered to actuate the programmed event.

Operation of the automatic compound feeding-steering means 38 will now be reviewed having reference especially to a typical cycle as shown in FIG. 9. It is again noted that the feeding-steering means can be responsive to pattern means moving with the work other than its edge E to determine the operating path of a tool such as the needle 20. In other applications, accordingly, the operating path need not progress parallel to a workpiece edge and need not merely determine a seam S such as illustrated in FIGS. 4 and 6 by way of example. With the ring 40 initially lifted from the surface 36, by means of the cam 80 for instance, the workpiece W is positioned on the surface and with the edge E appropriately disposed to underlie a leading end of the cord FC. The main motor (not shown) for operating the machine 10 and circuitry (not fully shown) for controlling the motor 82 being energized, the orbital ring 40 may be lowered for engagements with the work.

As has been indicated, in following a straight line pattern portion no corrective input to the motor 82 is signalled for by the cell 110 in the course of rectilinear feeding effected by the ring during its frictional engagement with the work, i.e. for about 85° of a cycle as shown in the horizontal feed section of FIG. 9. When the work edge E (or other controlling pattern means) approaching the tool 20 deviates from a straight or null condition, however, more or less illumination from the LED bank (then "on" if the vane switch for it is used and so determines) will be sensed by the cell 110 during the interval of feeding, i.e., as the vane 120 passes between the cell and receiver of the unit 130. Consequently the electrical signal to the motor 82 will correspondingly call for corrective rotation of the ring 40 in appropriate direction substantially about the vertical axis of the tool 20. Importantly, this steering correction is thus imparted to the work while it is being incrementally fed by the ring, assuring continually accurate guidance.

FIG. 9 also shows that the anti-flag 34 functions to prevent the work from being lifted by urging the work against the suface 36 for an interval overlapping the period of work penetration by the needle. Moreover, as illustrated graphically the anti-flag is free of the work during that portion of the cycle when the needle is also disengaged from the work and while feeding, including any work orientation, is being imparted by the ring 40. As further shown in FIG. 9, the servo system is made inoperative by the vane 120 during the interval from just prior to the anti-flag 34 engaging the work and until after the anti-flag is disengaged.

Focusing in particular on the steering performance of the ring 40, it entails no application of drag which might introduce a false deviation signal. Because of the symmetry of the ring itself, it need not be rotated back to a fixed angular position after each simultaneous feeding and steering increment. The planar under surface of the ring, which contacts the work edge both ahead of and in back of the operating locality of the needle, is of radial width adequate to impart feeding and turning moment to the work even though the latter to narrow or relatively flimsy such as the strap shown in FIG. 7. Additionally, the work-engaging surface of the ring and its disposition insures that the work can remain substantially flat and undistorted while accelerating and decelerating forces are being applied, and accordingly corners can be automatically "turned" i.e., progressively processed at a rapid rate. The mechanism for transmitting steering rotation to the ring 40, including as it does the reduction gearing 84, matches peak rotative speed requirements of the work W with the servo motor 82, and suitable steering torques can thereby be delivered while employing a minimum size motor 82. Also advantageously, the arrangement whereby the coupling 86 reversibly rotates the ring 40 via the shaft 88 and the belt 92 permits fixed mounting of the servo motor, and also permits economical use and adaptation of portions of known or standard top feed drive mechanisms for effecting orbital motion.

The cells 112 or 114 are activated by an inside or outside corner approaching the needle and exposing one or the other of the cells to illumination from the LED bank at that instant in each cycle when the raised ring 40 is about to descend onto the work, the instant being determined by the angular position and width of the vane 128. Accordingly motor speed of the machine 10 will be appropriately changed automatically as the corner is processed, i.e. the French cord is attached by stitches defining a path parallel to the work edge.

From the foregoing, it is apparent that this invention provides a versatile top-feed work-guidance mechanism.

Having thus described our invention, what we claim as new and desire to secure by Letters Patent of the United States is:

1. A machine comprising a tool movable toward and from a workpiece to be progressively processed, means for slidably supporting the workpiece adjacent to the operating locality of the tool, and a compound feeding-steering means movably mounted on and engageable solely with the opposite side of the workpiece from said workpiece supporting means for progressively orienting the workpiece by exerting torque while feeding it thereon, said feeding-steering means being responsive to predetermined pattern means which is movable synchronously with the work to automatically determine the operating path of the tool on the work.

2. A machine as in claim 1 wherein said compound means is an element orbitally driven into and out of successive engagements with the workpiece in timed relation to work engagements of said tool, the element simultaneously effecting feeding and steering of the work as determined by the pattern means in each interval that the tool is disengaged from the work.

3. A machine as in claim 2 wherein the element is a reversibly rotatable ring movable heightwise of its axis and effectively operative in a work contacting plane substantially parallel to the work supporting means and about an operating locality of said tool.

4. In a machine having an operating tool and a work supporting surface, a light-responsive edge guidance system for incrementally moving a workpiece on the surface and relative to the operating locality of the tool, said system comprising a work engageable orbital ring surrounding the tool, control means for causing the ring to impart, during each work engagement, substantially concurrent increments of feeding and steering to the work, and means for operating the tool to engage the workpiece alternately with the ring.

5. A sewing machine having a head and a work supporting surface spaced therefrom, stitching means carried by the head and including a needle reciprocable relative to a portion of the work supporting surface, and a unitary feeding-steering element movably mounted on the opposite side of the work from said portion of the work supporting surface for guiding a workpiece thereon, said feeding-steering element being responsive to a predetermined pattern control means thus to apply a turning moment to the work and about the axis of the needle incrementally to guide the work automatically during each increment the work is fed.

6. In a machine having a reciprocable operating tool and a work support upon which a flexible workpiece is slidable to determine the path of operation of the tool thereon, a curvature-controlled servo system comprising a rotary member movable toward and from said support and engageable with the work only on the side thereof opposite from said work support for predetermining said path of operation, mechanism for orbitally driving the member to cause it frictionally to impart increments of work feed, and guidance mechanism responsive to the servo system for causing the member while contacting the work to rotate according to sensed curvature to effect torque for work guidance during each feed increment.

7. A machine as in claim 6, wherein the member is a ring arranged, in the course of its orbital movement, to engage the work ahead, i.e. upstream, of the tool and behind, it, i.e. downstream, in the course of each cycle, the ring being rotatable about an axis substantially coincident with the axis of the reciprocating movement of the tool.

8. A machine as in claim 7, wherein the servo system comprises a source of illumination carried by the ring, an edge guidance cell responsive to the source and secured to the work support, and an inside and an outside curvature detecting cell respectively mounted on the support at opposite sides of the null line of said guidance cell, each of the three mentioned cells being disposed ahead of the work engaging locality of the tool and within an area approximately that defined by the path of the outer circumference of the work engageable surface of the ring.

9. A machine as in claim 7, wherein the mechanism for driving the orbital ring in rotation comprises a servo motor secured to a frame portion of the machine, reduction gearing interconnecting the servo motor to a drive shaft through a coupling, and sprocket driven belt means for transmitting rotation of the shaft to said ring during its orbital movement.

10. In a sewing machine having a work support and stitch forming means including a needle reciprocable relative to an operating locality of the support, a combination work feeding and work guidance mechanism for controlling movement of a workpiece on the work support with respect to the needle, the combination mechanism comprising means for orbitally driving a ring heightwise into and out of incremental feeding engagement with the work, and curvature-controlled means for causing the ring to rotate during each of its feeding engagements about an axis substantially normal to said operating locality to orient the workpiece thereat, the ring being effectively operative in intervals when the needle is disengaged from the work.

11. A sewing machine as in claim 10, wherein the means for orbitally driving the ring in feeding engagements carries, adjacent to the needle, a spring-pressed anti-flag engageable with the work in each cycle just ahead of work engagements of the needle and until just after needle disengagement with the work.

12. A machine as in claim 10, wherein a rotatable main shaft for driving the needle has operative connection to the means for orbitally driving the ring, and another shaft is rotatable to control timing of said curvature-controlled means synchronously with a portion of the feeding orbit of said ring.

13. In a sewing machine having a frame, a rotary main shaft journalled therein, a reciprocable needle operatively connected to the main shaft, and a work support for slidably holding a workpiece, compound edge guidance and feeding mechanism for moving the work on the support and relative to the operating locality of the needle in the intervals when the needle is disengaged from the work, said compound mechanism comprising an orbital ring rotatable about an axis substantially parallel and adjacent to that of the needle, means interconnecting the main shaft and the ring for imparting orbital work feeding motion to the ring, and a servo system for automatically controlling work guidance rotation of the ring concurrently with its successive feeding engagements with the work, said system including a servo controlled motor fixedly mounted on the frame and a beam-responsive edge sensor for signaling to the servo motor change in curvature of a work edge approaching the operating locality of the needle.

14. A machine as in claim 13 wherein said system comprises a bank of light emitting diodes mounted for orbital movement with the ring and arranged to illuminate said sensor to the extent it is not masked by the work.

15. A machine as in claim 13 wherein said means for imparting orbital work feeding motion to the ring comprises an oscillatory, vertically reciprocable member for carrying the ring and a light source, and said system comprises a belt drive for transmitting guidance rotation from the servo motor to the ring; and a take up means for accommodating translatory and heightwise motion of said member relative to the driving axis of said servo motor.

16. A machine as in claim 14 wherein a bobbin drive shaft is provided, and control means actuatable by operation of the bobbin drive shaft determines the selected portion of the orbital motion of the ring wherein said sensor is to progressively detect change in said work edge curvature.

* * * * *